US005747129A

United States Patent [19]

Malofsky et al.

[11] Patent Number: 5,747,129

[45] Date of Patent: *May 5, 1998

[54] CHILD AND INFANT ENCLOSURE STRUCTURE

[75] Inventors: Adam G. Malofsky, Huntington; Bernard M. Malofsky, Bloomfield, both of Conn.; Paul R. Glassberg, Chester, N.J.

[73] Assignee: Piccolino, LLC, Huntington, Conn.

[ * ] Notice: The term of this patent shall not extend beyond the expiration date of Pat. No. 5,533,215.

[21] Appl. No.: 727,855

[22] Filed: Oct. 4, 1996

Related U.S. Application Data

[63] Continuation-in-part of Ser. No. 307,924, Sep. 16, 1994, Pat. No. 5,561,874.

[51] Int. Cl.[6] ..... A47D 7/02

[52] U.S. Cl. ..... 428/36.4; 5/93.1; 5/655; 5/948

[58] Field of Search ..... 5/93.1, 99.1, 948, 5/655, 200.1, 93.2–98.3; 428/36.4

[56] References Cited

U.S. PATENT DOCUMENTS

| | | | |
|---|---|---|---|
| 3,654,645 | 4/1972 | Lee | 5/99 |
| 4,491,992 | 1/1985 | Wittman | 5/93 R |
| 5,535,457 | 7/1996 | Welsh, Jr. et al. | 5/93.1 |

*Primary Examiner*—Charles Nold
*Attorney, Agent, or Firm*—William A. Simons; Wiggin & Dana

[57] ABSTRACT

Playpen and crib construction which utilizes in the frame a high modulus fiber-reinforced plastic matrix solid composite sections.

8 Claims, No Drawings

CHILD AND INFANT ENCLOSURE STRUCTURE

CROSS-REFERENCE TO RELATED APPLICATION

This is a continuation-in-part application of U.S. patent application Ser. No. 08/307,924 filed Sep. 16, 1994, U.S. Pat. No. 5,561,874. That parent application is incorporated herein by reference in its entirety.

BACKGROUND OF THE INVENTION

1. Field of the Invention

The present invention relates to child and infant enclosure structures (e.g., playpens, cribs, play yards, bassinets and other similar enclosures). In particular, the present invention relates to child and infant enclosure structures made of selected solid composite members.

2. Brief Description of the Art

Most infant's and children's playpens and cribs are currently constructed using steel, aluminum, or other metal tubular frames. These materials, in their usual form, provide the requisite strength and stiffness required to satisfy the physical demands of the application. The use of metal tubing, as described by the prior art, allows for a foldable design that is both practical and yet employs a minimal use of the specified structural materials.

Consumer Reports (May, 1993) page 288 lists several considerations when buying a portable crib. Those include light weight; ease of assembly and disassembly; ease of storing and transporting; and lack of sharp edges, finger entrapments or small parts.

The standard methods of constructing metal tubular playpens and cribs involve cutting the metal tubing the required lengths, punching out the required holes for fittings, and then fastening the tubing together in a design that provides for the convenient folding, storage, and transportation of the playpen.

The use of metal tubing currently infers a high degree of quality that other materials such as plastics do not convey. Separately, the use of metal tubing, versus metal plates or solid rods or other solid metal forms, allows for some weight minimization that would not otherwise be possible and also provides for playpen or crib designs that can be easily and conveniently folded, stored, and transported.

Unfortunately, the use of metal tubing in a playpen or crib results in a still relatively heavy product. The use of metal tubing also requires the use of connective fittings and hinges that may themselves constructed of metal or partially metal parts. These add to the weight of the product and make it less convenient to fold, store, and transport. Metal parts also require complicated coatings or treatments to minimize or prevent corrosion, even under ambient humidity conditions. Corrosion results in weakened parts which may unexpectedly fail. These corroded surfaces and chemical coatings may also be highly toxic to the infants. Such pretreatments necessary to coat the metal are also time intensive and relatively expensive, thus lengthening the production time and cost of the product.

Thermoplastic and thermoset plastic tubes of similar dimensions to these metal tubes have alternatively been considered for this use. It is noted that the use of thermoset or thermoplastic tubing or rods would allow for weight minimization that would not otherwise be possible with metal parts. Additionally, the use of thermoset or thermoplastic tubing or rods versus rigid thermoset or thermoplastic plates, mesh or other forms also would provide for playpen or crib design that could be easily and conveniently folded, stored, and transported. However, most economical plastics do not possess the required stiffness to maintain long term dimensional stability. Under the loads required by ASTM Test Method F406 for playpens, the most economical thermoplastics will deflect and even permanently deform or break. Such properties are not acceptable and pose a significant risk to an infant. Specifically, their relatively poor physical strength and stiffness require thicker walled tubes or even solid rods. Such tubes or rods dramatically increase the weight of the product. Additionally, the use of plastics in general also infer a lack of quality or "cheapness" that further detracts from their use as primary structural materials in such products. Moreover, while plastics do not corrode and do not usually require the use of coatings or pretreatments, coating plastics is time-intensive and relatively complicated and again causes more expensive and longer production times.

Certain composite materials have properties that preclude their use for playpen or crib applications. For example, ceramic-metal and wood-thermoset plastic composites have the disadvantage of their relative heavy weight. In this regard, it is noted that U.S. Pat. No. 3,916,802 states that an infant dressing table " . . . may be constructed of wood or fiber composite materials". It is also noted the reference does not provide any teaching of any preferred type of fiber composite material of the present invention. Glass fiber reinforced polyester matrix composites are an improvement of the aforementioned composites, but these latter materials are relatively thick and bulky.

U.S. patent application Ser. No. 08/307,924, still pending, and its continuation-in-part U.S. patent application Ser. No. 08/501,506, now U.S. Pat. No. 5,533,215 described improved materials and an improved design for child and infant enclosure structures which overcomes the problems associated with above-described materials. The lightweight, high modulus fiber-reinforced plastic matrix composite tubing materials described in U.S. patent application Ser. No. 08/307,924 and U.S. Pat. No. 5,533,215 provide lightweight, durable, strong, stiff noncorroding parts that feel and sound like metal, and allow for a design that is itself lightweight, of consistent quality, safe, durable and easily folded, stored and transported, all at a relative low cost. While these tubing materials can be used for the vast majority of playyard frame parts and represent a large improvement over the prior art metal and plastic frame parts, there are certain situations where the playyard parts must have more stiffness and be more amenable to different types of fabrication on assembly with either each other or other materials such as fabrics. The present invention offers a solution to those problems.

BRIEF SUMMARY OF THE INVENTION

Specifically, one aspect of the present invention is directed to a child or infant enclosure structure comprising a base and a multiside enclosing frame wherein said frame comprises solid composite sections made of lightweight, high modulus fiber-reinforced plastic matrix composite solid members have a weight of 0.30 pounds or less per lineal foot and wherein said plastic matrix is a thermoplastic resin or thermoset plastic resin with a minimum modulus of 250,000 psi; a minimum tensile strength of 6,000 psi; and a glass transition temperature of at least 50° C. and wherein said high modulus fiber reinforcement is selected from the group consisting of carbon fibers, aramid fibers, glass fibers, polyolefin fibers, boron fibers, and mixtures thereof.

Other aspects of the present invention involve the combination of the above-defined composite members with the playyard design features shown in U.S. patent application Ser. No. 08/307,924 and U.S. Pat. No. 5,561,874 and U.S. Pat. No. 5,533,215.

DETAILED DESCRIPTION OF THE PREFERRED EMBODIMENTS

The term "composites" as used in the present specification and claims is defined as those materials found by distributing extremely strong and stiff, continuous, chopped, or a mixture of fibers in a polymer resin matrix or binder.

The term "high modulus fiber reinforcement" as used in the present specification and claims is defined as a collection of fibers employed possessing an average modulus of at least 5,000,000 psi, preferably 15,000,000 psi, and most preferably at least 30,000,000 psi.

The term "plastic resin matrix or binder" as used in the present specification and claims is defined as any thermoset or thermoplastic resin with a minimum modulus of about 250,000 psi, preferably about 325,000 psi, and most preferably, at least about 400,000 psi; a minimum tensile strength of about 6,000 psi, preferably about 10,000 psi, and most preferably at least about 12,000 psi; and glass transition temperature (Tg) of at least about 50° C., preferably at least about 75° C., and most preferably, at least about 100° C.

Preferred examples of higher modulus fiber reinforcement material include carbon fibers, aramid fibers, glass fibers, polyolefin fibers, boron fibers, and the like. Most preferred is carbon fibers alone or in combination with other fibers.

Preferred examples of the plastic resin matrix or binder include plastic resins such as nylon, high-strength polyethylene, liquid crystalline polyethylene, epoxy resins, cyanurates, polyesters, and polyurethanes and the like. Most preferred is epoxy-type thermoset resins and nylon-type thermoplastic resins.

Generally, the high modulus fibers used herein are typically at least about 50 times stronger and at least about 20–150 times stiffer than the plastic resin matrix used herein. The role of the matrix is primarily that of a glue or binder that enables the high modulus fibers to support the applied loads.

In the composites used in the present invention, the ratio of high modulus fibers to plastic resin mixture is preferably from 30:70 to 70:30 by volume, more preferably, 40:60 to 60:40 by volume.

While numerous profiles or cross-sections may be used in forming the solid members, the specific profile will be chosen to achieve a certain set of desired, non-isotropic properties having no voids. For example, C channels and I-beam cross sections are commonly utilized to achieve greater stiffness and strength in one direction while minimizing materials usage. Alternatively, solid rods with no voids with circular or square cross sections are used in places which require higher damage tolerances or general robustness. Accordingly, weight limitations coupled with the specific cross-section geometry used define the final dimensions (e.g., mean diameter) of the solid member. An example of when a solid circular or square cross section may be required is when rivets or other connective fittings may be placed in holes made in said solid member. Another example where damage tolerances may have to greater are on parts that may be subject to repetitive, physical abuse.

Fiber angles of the composite members may be either a combination of high and low angles to the axis of the member to impart maximum rigidity and strength per unit weight or a single angle for ease of manufacturing and lower cost. If a combination of fibers is used, the angle combination should be preferably isotropic angles. In the case of solid members made from a single tow with a single angle, the preferred angle should fall between 0° and 50°, more preferably from 0° to 40°, and most preferably from 0° to 30°.

Overall member weight should be no more than 0.30 pounds per lineal foot, preferably no more than 0.20 pounds per lineal foot, and most preferably no more than 0.15 pounds per lineal foot.

The high modulus fibers and plastic resin matrix or binder combined to form composites used in the present invention by any standard composite fabrication technique. Pultrusion is one preferred method when economics of scale and high speed are required, especially when the core layer is being produced with an angle of 0°. Other alternative constructions are circ winding, filament winding, injection molding, braiding, resin transfer molding and roll wrapping, alone or in combination with each other.

The composite members of the present invention as well as the connective fittings, supports, and folding mechanisms described herein may be made of any suitable materials, including molded plastics containing lightening fillers, such as microballoons and other low-density fillers, whose density is no more than 0.9 grams per cubic centimeter.

This invention has many unique and significant advantages over the prior art metal and plastic tubings. In contrast to using either metal, thermoset plastic tubing, or thermoplastic tubing, using high modulus fiber plastic matrix reinforced composite members results in a dramatic reduction in frame weight without a loss of strength. This weight loss, without a loss in strength, provides for a playpen or crib that can be easily and conveniently folded, stored, and transported. Long, high modulus fiber/plastic matrix reinforced composites are desired over short, high modulus fiber plastic matrix reinforced composites because of their overall superior strength and stiffness. Oriented, long, high modulus fiber plastic matrix reinforced composites are even more preferred because of their even more superior strength and stiffness. Additionally, high modulus fiber plastic matrix reinforced composites, because of their high stiffness, dimension stability, and acoustic properties, do not dampen or significantly distort sound. Accordingly, unlike unreinforced plastics or short, high modulus fiber/plastic matrix reinforced composites, high modulus fiber plastic matrix reinforce composites have metal-like properties and infer a quality appearance. Unlike metals and more easily than most plastics, composites may be readily coated for decorative purposes and will not corrode.

This invention further improves upon the construction of members made from fiber-reinforced plastic matrix composites. It has been found that certain types of constructions are more economical, are faster to produce, are less complex to manufactured, minimize the amount of material used, and yet the final tubing still exhibits all of the desired properties. Specifically, a construction which utilizes a single tow of fibers and a single fiber angle in the construction of the fibers within the member is one of the most economical, fast, and least complex. In this invention, we have found that only certain angles of fiber for the desired specifications of the members will favor the desired member properties. Using angles outside of this range when only a single angle is utilized will produce members that will fail to perform as desired or that will fail to fall within the desired member specifications if the desired performance is achieved. These fiber angles generally fall between 0° and 50°. The use of multiple angles outside of this range can overcome some of these shortfalls, as has been previously described, but the manufacturing process is more complex, less favorable, is more expensive, and more time consuming. A common method of constructing solid rods is to use an angle of 0° for the core and where robustness and higher overall structural integrity is desired, a single or group of angles between 10° and 90° may be used for outer layers.

While the invention has been described above with reference to specific embodiments thereof, it is apparent that many changes, modifications, and variations can be made without departing from the inventive concept disclosed herein. Accordingly, it is intended to embrace all such changes, modifications, and variations that fall within the spirit and broad scope of the appended claims. All patent applications, patents, and other publications cited herein are incorporated by reference in their entirety.

What is claimed is:

1. A child enclosure structure comprising a base and a multiside enclosing frame wherein said frame comprises solid composite sections made of lightweight, high modulus fiber-reinforced plastic matrix composite solid members having a weight of 0.30 pounds or less per lineal foot and wherein said plastic matrix is a thermoplastic resin or thermoset plastic resin with a minimum modulus of 250,000 psi; a minimum tensile strength of 6,000 psi; and a glass transition temperature of at least 50° C. and wherein said high modulus fiber reinforcement is selected from the group consisting of carbon fibers, aramid fibers, glass fibers, polyolefin fibers, boron fibers, and mixtures thereof.

2. The structure of claim 1 wherein said plastic matrix is an epoxy thermoset plastic.

3. The structure of claim 1 wherein said plastic matrix is a nylon thermoplastic resin with a minimum modulus of 325,000 psi and a minimum tensile strength of 10,000 and a thermoplastic resin $T_g$ of at least 75° C.

4. The structure of claim 1 wherein ratio of high modulus fibers to plastic matrix is from 70:30 to 30:70 by volume.

5. The structure of claim 1 wherein said solid composite selections is constructed by a pultrusion process.

6. The structure of claim 1 wherein the high modulus fiber reinforcement is carbon fibers.

7. A playyard made of the composite solid members of claim 1 and connective fittings, supports, and folding mechanisms consisting of molded plastics containing lightening fillers, whose density is no more than 0.9 grams per cubic centimeter.

8. The structure of claim 1 wherein the core of said solid member has an angle of 0° and the outer layers having an angle of between 10° and 90°.

* * * * *